US005109581A

United States Patent [19]

Gould

[11] Patent Number: 5,109,581

[45] Date of Patent: May 5, 1992

[54] DEVICE AND METHOD FOR SECURING A SHOE

[76] Inventor: Murray J. Gould, 11712 Silent Valley La., Gaithersburg, Md. 20878

[21] Appl. No.: 642,869

[22] Filed: Jan. 18, 1991

[51] Int. Cl.[5] ..... A43C 5/00

[52] U.S. Cl. ..... 24/714.6; 24/712.1; 24/713.9; 24/714.8

[58] Field of Search ..... 24/714.6, 714.7, 714.8, 24/712.1, 713.3, 713.4, 713.9

[56] References Cited

U.S. PATENT DOCUMENTS

| | | | |
|---|---|---|---|
| 301,854 | 7/1884 | Buch | 24/714.6 |
| 1,493,345 | 5/1924 | Kern | 24/714.6 |
| 1,502,919 | 7/1924 | Seib | 24/714.6 |
| 1,505,430 | 8/1924 | Roberts et al. | 24/714.8 |
| 1,697,893 | 1/1929 | Winlow | 24/714.6 |
| 1,934,455 | 11/1933 | Staude et al. | 24/713.9 |
| 2,871,537 | 2/1959 | Hickerson | 24/712.1 |
| 4,538,367 | 9/1985 | Adams | 24/714.6 |
| 4,974,299 | 12/1990 | Moon | 24/714.6 |

FOREIGN PATENT DOCUMENTS

| | | | |
|---|---|---|---|
| 0320544 | 12/1902 | France | 24/714.6 |
| 0328342 | 7/1903 | France | 24/714.6 |
| 0469418 | 7/1914 | France | 24/714.8 |
| 0041376 | 10/1914 | Switzerland | 24/714.6 |

*Primary Examiner*—Victor N. Sakran
*Attorney, Agent, or Firm*—Longacre & White

[57] ABSTRACT

A device and method for securing onto a foot a shoe having openings adjacent opposed edges and adapted for normally having a lace threaded therethrough, in which a plurality of fastening members are mounted, preferably slidably, on a longitudinally extending band which may be decorated on at least one surface. The fastening members are manually and releasably engaged in respective openings, so that the band extends across the upper part of the shoe back and forth between the edges. After tightening, the band lies adjacent the upper surface of the shoe, like a conventional shoelace, and secures the shoe to the foot of a wearer. The longitudinally extending band can be made much wider than conventional shoelaces and different bands may be easily and quickly substituted by simply disengaging the fastening members from their respective openings and replacing the device with another. The fastening members may take a variety of different forms. The principles behind the invention may be extended to provide a decorative cover for the laces of a conventionally secured shoe. The cover is either of elastomeric material and secured to the openings in the shoe by clips, or is of e.g. flexible plastic and secured to the laces by resiliently attached hooks.

20 Claims, 6 Drawing Sheets

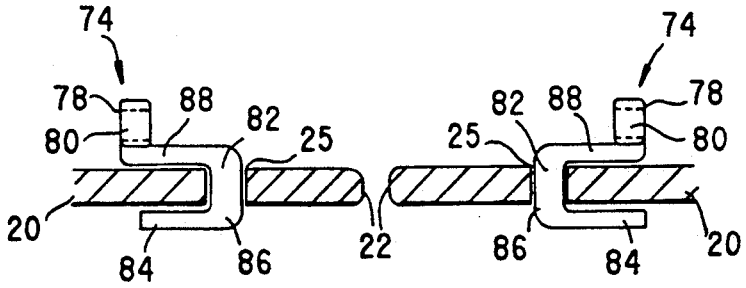
Fig.11
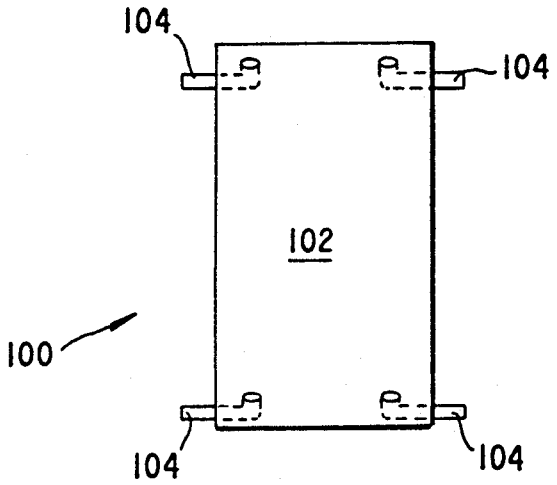
Fig.13
Fig.14
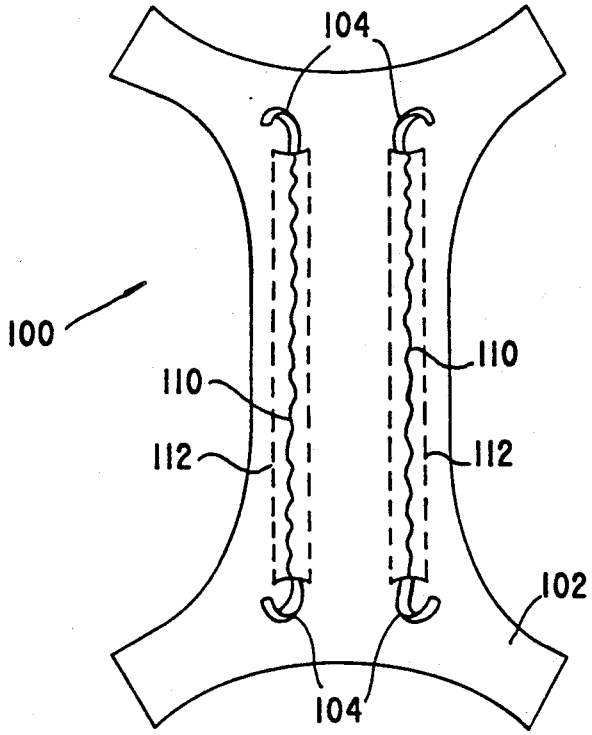

DEVICE AND METHOD FOR SECURING A SHOE

FIELD OF THE INVENTION

The invention relates to a method and apparatus for securing a shoe or the like to the human foot while providing interesting and attractive decoration.

BACKGROUND OF THE INVENTION

Traditionally, footwear has been secured to the foot by means of a strip of material or thong. Early man discovered that removal and resecuring could be made relatively simple by forming holes near the edges of the material forming the footwear and threading the strip of material alternately through the holes of adjacent edges. Thus, was invented the first "shoelace" which has changed remarkably little in the intervening thousands of years.

Not only does the shoelace provide the necessary function, loafers and the like aside, of ensuring satisfactory securing onto the foot, but it provides important decoration as well. Laces are made in a wide variety of patterns and colors to provide the wearer with an opportunity to use the lace as an accessory. And there is no doubt that these traditional laces perform these functions or they would not still be in near universal use after all these years.

However, the traditional lace does have several drawbacks, notwithstanding its virtues and near universality. One of those is the limited area of the lace which is available for view and hence the limited visual impact a lace decoration can have. It is true that the lace width can be increased somewhat, but increasing the width makes drawing the lace through the holes more difficult. Also, the cross-section of the lace is invariably compressed and the lace deformed under tension, reducing its decorative impact.

Secondly, threading the laces through the holes is a time consuming operation requiring manual dexterity. It is impractical to change the laces as often as a fashion conscious person might change other accessories, and yet given the option that is exactly what many, particularly young, people would very much like to do.

Thirdly, the fact that laces are so universal establishes a need for an alternative from a fashion standpoint. After all, it is the ability to choose which is fundamental to fashion.

SUMMARY OF THE INVENTION

The present invention relates to a unique alternative to the age-old shoelace. It can be employed with ordinary shoes which are intended to lace in a conventional manner or on shoes which are designed and made to take advantage of the present invention. It can be attached in seconds and removed with equal speed and ease, making possible practical use as a fashion accessory. The visible surface can be made as wide as desired, and it retains its width under tension.

At the same time the present invention secures the shoe onto the foot as effectively as the common and traditional lace. In contrast with the traditional lace, however, the easy removability of the present invention facilitates airing-out of the shoe after each wearing. Moreover, these unique capabilities are achieved by a simple device, the cost of which is comparable to the traditional lace.

Accordingly, in a first aspect the present invention provides a device for securing a shoe onto a foot of a wearer, the shoe including an upper part having a pair of opposed edges to be drawn together by the device and the upper part having a plurality of openings therein adjacent each of the edges. The device comprises a longitudinally extending band and a plurality of fastening members each for attachment to the band and each for engagement with a respective opening in the upper part of the shoe so that the band extends across the upper part back and forth between the edges, to removably attach the band to the upper part of the shoe at each of the openings without being threaded through the openings.

Thus, the device of the invention enables the band to be attached to the upper part of the shoe for drawing together the opposed edges without having to thread the band through the openings. This allows the whole band to lie above the shoe and virtually the entire length of band to be visible, as compared with a conventional shoelace which is threaded through the openings and has a substantial part which is obscured by the upper part of the shoe. This enables the band of the present invention to play a more prominent role in creating a certain visual impact, for example resulting from a decorative surface or surfaces thereof, which increases its importance as an element of fashion.

The fastening members may take a variety of different forms. In a first form, which is the most preferred, each of the fastening members is attached to the band and is adapted for releasable engagement with a respective opening in the upper part of the shoe. In a preferred embodiment of this form of fastening member, each fastening member is a clip comprising an upper portion which is attached to the band and a leg adapted for insertion through a respective opening from above for releasable engagement of the clip with the respective opening. Preferably, the leg includes a first leg portion for location in the respective opening, and a second leg portion angled with respect to, e.g. perpendicular to, the first leg portion for preventing disengagement of the clip from its respective opening when the shoe is secured on the foot of the wearer. The first and second leg portions are preferably connected by an arcuate bridging portion, in order to assist insertion of the clip in and removal of the clip from its opening in the shoe. The second leg portions of successive clips preferably point in the same longitudinal direction along the band but are located on opposite sides of the band, in order that when the shoe is secured to the foot the second leg portions of each of the clips point in a direction away from the opposed edges of the upper part of the shoe. This has two advantages: firstly, as the opposed edges are drawn together by the engaged clips, for example by tightening the band, the free ends of the second leg portions of the clips abut the lower surface of the upper part of the shoe, which limits the degree of rotational movement of the clips as the band is tightened. This leaves a greater distance between the clips attached along each edge for visual display of a decorative surface of the band and thereby creates increased visual impact of such a decorative band; and secondly, this configuration of the clips when the shoe is secured on the foot of a wearer helps to eliminate the problem of protruding portions of the clips causing discomfort or injury to the wearer. The clips may be made of any suitable material, for example metal, such as steel, aluminum or an alloy thereof, or a plastic, such as nylon.

In a second form, each of the fastening members comprises a first fastening element attached to the band and a second fastening element engaged with a respective opening and the first and second fastening elements are releasably interengagable for removably attaching the band to the upper part of the shoe at the openings. In one embodiment of this form of fastening member, the first fastening element attached to the band is one of a hook member and an eye member and the second fastening element engaged with a respective opening is the other of the hook member and the eye member. In one configuration the hook member of each fastening member is attached to a respective opening, for example by means of a flanged portion inserted through the opening, from which flanged portion the hook protrudes upwardly, and the eye member is provided by a rigid loop formed in part of a member attached to the band. Alternatively, the members carrying the hook and eye may be reversed, so that it is the hook member which is carried by the band and the eye member which is attached to a respective opening. In another embodiment of this form of fastening member, the first fastening element attached to the band is one of a female member and a male member and the second fastening element engaged with a respective opening is the other of the female member and the male member. Preferably, the female member is located in a respective opening and the male member is attached to the band, although the reverse may be the case, if desired. Conveniently the female and male members are releasably interengagable by means of at least one protrusion on one of the members and at least one corresponding recess in the other, which protrusion(s) and recess(es) form a snap-fitting connection. In this second form of fastening member, either of the fastening elements may be permanently or releasably attached to the band or engaged with a respective opening, as the case may be, depending upon whether or not it is desired that those elements should be replaceable or transferable, for example if it is desired to use a given band on a variety of shoes requiring different types of fastening elements or to use a variety of bands requiring different types of fastening elements on a given shoe.

In a third form, each fastening member is engaged with a respective opening and is adapted for releasable attachment to the band. In one embodiment of this form of fastening member, each of the fastening members comprises a hook for releasably retaining a respective portion of the band In another embodiment each of the fastening members comprises a loop, a portion of which forms a gate. The gate portion is hingeable between an open position in which the loop is open to allow a respective portion of the band to enter the loop via the open gate portion and a closed position in which the loop is closed to prevent removal of the respective band portion from the loop via the gate portion. Preferably, the gate is biassed so as to be normally closed, enabling a respective band portion to be located and retained in the loop by the single, simple operation of pushing the gate open while slipping the band portion past it. The band portion can be removed from the loop by simply sliding it therethrough. With this third form of fastening member, the band itself need no longer have attached to it any fastening member or element thereof. The fastening members engaged with the respective openings are preferably releasable therefrom, to allow them to be replaced or transferred, as with the second fastening elements of the second form of fastening member mentioned above.

The band of the device of the invention may be made of a variety of materials, for example cloth or plastic. A wide range of characteristics such as cross-sectional shape, width, texture, constructional form (e.g. laminar, single strand, multi-strand, woven), color and design are available and may be selected according to the demands of fashion or according to personal taste. The invention thus allows great versatility in the choice of band. A range of materials may also be used to form the various forms of fastening member ( or elements thereof) of the device, suitable materials being metal, nylon or other plastic.

In a preferred device according to the invention each fastening member comprises a portion defining an aperture, e.g. an elongate slot, through which the band extends. Desirably, at least some of the fastening members are slidable longitudinally relative to the band, to allow the band to be tightened for tightening the shoe on the foot. Preferably, at least some of the fastening members are swivellable when engaged with their respective openings, so that those fastening members can orient themselves under tension from the band so as to bisect the angle between incoming and outgoing portions of the band at each respective fastening member. This assists in preventing the band from undergoing distortion and/or structural damage over time, particularly when a wide band is used.

Once the shoe has been secured to the foot, the free end or ends of the band may be secured by any suitable means. For example, when there are two free ends, they may be simply tied together in the same manner as a conventional shoelace or possibly may be secured together by means of Velcro (trademark) material. When there is a single free end, Velcro may be used to secure the free end to the upper part of the shoe. A further possibility is that at least one of the fastening members is a terminal fastening member and at least one free end of the band is releasably securable to a respective terminal fastening member. Yet another possibility is for the at least one free end of the band to be securable to a permanent fixture, e.g. a cleat or buckle, provided on the upper part of the shoe.

Since the device of the invention enables the band to be attached to the shoe without being threaded through the openings, the band may be made substantially wider than conventional shoelaces. Typically the band may be at least a quarter inch wide. This feature enables a decorative surface or surfaces of the band to have a much greater visual impact or appeal.

In a second aspect, the present invention provides a method of securing a shoe onto a foot of a wearer, the shoe comprising an upper part having a pair of opposed edges to be drawn together and also having a plurality of openings therein adjacent each of the edges, using the device of the first aspect of the invention.

Thus, a first method in accordance with this aspect of the invention comprises: (i) providing a longitudinally extending band having a plurality of fastening members attached thereto; and (ii) manually and releasably engaging the fastening members with at least some of the openings so that the band extends across the upper part back and forth between the edges and is removably attached to the upper part of the shoe at each of the openings without being threaded through the openings and so that the edges are drawn together to secure the shoe on the foot.

A second method in accordance with this aspect of the invention comprises: (i) engaging with at least some of the openings respective second fastening elements of a plurality of respective fastening members; (ii) providing a longitudinally extending band having a plurality of first fastening elements of the respective fastening members attached thereto; and (iii) manually and releasably interengaging the first fastening elements with the second fastening elements so that the band extends across the upper part back and forth between the edges and is removably attached to the upper part of the shoe at each of the openings without being threaded through the openings and so that the edges are drawn together to secure the shoe on the foot.

A third method in accordance with this aspect of the invention comprises: (i) engaging with at least some of the openings respective fastening members; (ii) providing a longitudinally extending band; and (iii) manually and releasably attaching the band to the fastening members so that the band extends across the upper part back and forth between the edges and is removably attached to the upper part of the shoe at each of the openings without being threaded through the openings and so that the edges are drawn together to secure the shoe on the foot.

In any of the above three methods, the band preferably has at least one decorative surface at least part of which is visible when the shoe is secured to the foot of the wearer. Preferably, at least some of the fastening members are slidable relative to the band and the edges of the upper part of the shoe are drawn together by tightening the band by pulling the band and slidably displacing at least part of the band relative to the fastening members or first fastening elements, as the case may be. The tightening step may include stretching the band, i.e. in the longitudinal direction thereof.

In arriving at the various embodiments of the device of the present invention, it has been realised that the fundamental inventive concept embodied herein can be extended so as to provide a cover, particularly a decorative cover, which is releasably attachable to the upper part of the shoe so as to overlie the openings and shield from view the laces or other device which secures the shoe onto the foot of a wearer. In essence, the band of the above-mentioned device is replaced with a continuous sheet member of dimensions sufficient to cover at least the part of the upper part of the shoe containing the openings, and a plurality of fastening members are provided each for attachment to the sheet member and each for releasable engagement with a respective opening in the shoe or with the laces or other shoe-securing device. The sheet member is preferably of an elastomeric material, e.g. Spandex (trademark), or a flexible plastic. Particularly in the case of an elastomeric sheet member, it may be desirable that the sheet member has edges which are semi-rigid, that is to say edges which do not undergo substantial deformation during attachment of the cover to the shoe, in order to preserve the appearance of any design or decoration provided on its upper surface.

The cover of this, third, aspect of the present invention is particularly suitable for use with conventionally secured shoes, i.e. those secured with normal laces, but it may also be used in conjunction with (i.e. in addition to) various forms of the device of the first aspect of the invention. In either case, anchor points for the cover are provided either by the openings in the upper part of the shoe or by the laces or band used to draw the opposed edges together. (In the context of this aspect of the invention the terms "laces" and "band" are used interchangably and no limitation to either form of shoe securing means is intended.)

The upper surface of the sheet member of the cover provides a convenient and readily visible site for decoration by any desired means. For example, the sheet member may itself be formed of a decorative material or it may have applied to it a decorative feature, such as by way of printing or the application of a label or sticker. The continuous surface and greater available surface area provided by the cover of this aspect of the invention can even further enhance the potential visual impact, and thus availability and importance as a fashion accessory, of what has hitherto been a feature of dress of a regrettably mundane and utilitarian nature.

The fastening members for attaching the sheet member to the upper part of the shoe may be of any suitable form, but preferably take the form of any of the fastening members described herein for use with the device of the first aspect of the invention. Most preferred is a fastening member in the form of a clip which includes an upper portion which is attached to the sheet member and a leg adapted for insertion through a respective opening in the shoe, enabling the clip to be releasably engaged with the respective opening. An alternative preferred fastening member is one which is a clip having a portion forming a hook for releasable engagement with either the lace or band or with a respective opening. In this form of fastening member, the hooked clips may suitably be arranged in one or more pairs and the clips of the or each pair attached to opposite ends of a resilient element, such as a length of elastomeric material or a spring. The resilient element or elements are attached to the sheet member, for example by being supported in a channel portion or portions thereof. The channel portion(s) may be aligned approximately parallel to or transverse to the direction of the opposed edges of the upper part of the shoe, in order to facilitate engagement of the clips either with the lace or band or with the openings in the shoe, as the case may be.

BRIEF DESCRIPTION OF THE DRAWINGS

FIG. 11 is a part-sectional view of another modified form of the preferred fastening member of FIG. 1;

FIG. 13 is a top plan view of one preferred form of cover for an upper part of a shoe, in accordance with the third aspect of the invention;

FIG. 14 is a bottom plan view of another preferred form of cover for an upper part of a shoe.

DETAILED DESCRIPTION OF PREFERRED EMBODIMENTS

Figure 1:
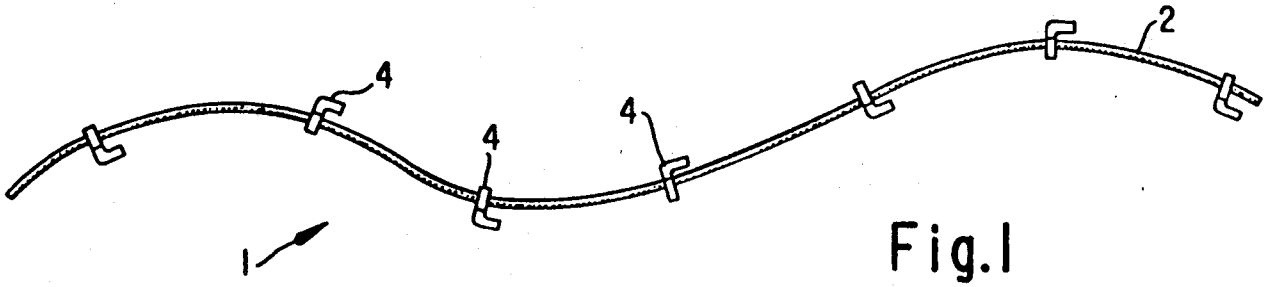
FIG. 1 is a side view of a preferred device in accordance with the invention showing a preferred form of fastening member each of which is attached to the band.
Figure 2A:
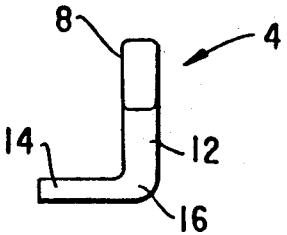
FIGS. 2[*a*]-[*e*] are enlarged side, front, rear, top and bottom views, respectively, of the preferred fastening member shown in FIG. 1.
Figure 2D:
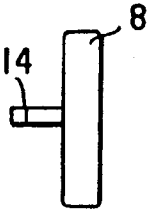
Figure 2E:
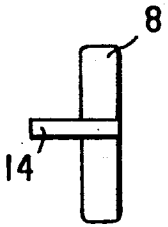
Figure 2C:
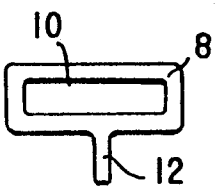
Figure 2B:
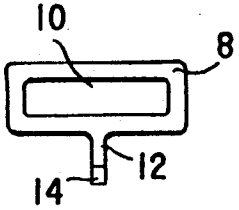

Referring firstly to FIG. 1, a device 1 in accordance with the invention comprises a longitudinally extending band 2 to which are slidably attached a plurality of fastening members 4. The length of the band 2 and the number of fastening members 4 will depend on the size of the shoe with which the device is to be used and the number of openings in the upper part of the shoe at which the band is to be engaged. FIG. 1 does not show the end portions of the band 2, for reasons of clarity and these will be described later.

The preferred form of fastening member, as seen in FIG. 1, is shown in greater detail in FIGS. 2[*a*]–[*e*]. Each fastening member 4 is in the form of a clip comprising an upper portion 8 having an aperture 10 therein, the upper portion 8 being attached to a leg 12, 14, 16. The leg comprises a first leg portion 12 for location in an opening in the upper part of the shoe and a second leg portion 14 substantially perpendicular to the first leg portion 12, for abutting the lower surface of the upper part of the shoe for preventing disengagement of the clip 4 from the opening when the shoe is secured on the foot. In order to assist removal of the clip 4 from an opening, the first 12 and second 14 leg portions are connected by an arcuate bridging portion 16. The aperture 10 of the upper portion 8 may be of any suitable shape and size, depending upon the shape and size of the band 2 to be threaded therethrough. In a preferred embodiment, the aperture 10 is a single elongate slot as shown in FIG. 2, which enables a band of substantially greater width than a conventional shoelace to be utilized. Alternatively, it is possible for there to be two or even three or more separate apertures provided in the upper portion 8 of the clip 4, so that a band comprising an appropriate number of separate stands or even a plurality of individual bands alongside one another may be used. As shown in FIG. 1, second leg portions 14 of successive clips 4 point in the same longitudinal direction along the band but are located on opposite sides of the band. This is so that when the shoe is secured on the foot the second leg portions 14 of the clips 4 all point in a direction away from the opposed edges which are drawn together by the device, the purpose of which has already been mentioned and is further discussed below. Each of the clips 4 is slidable along the band 2, so that the device may be fitted to any size of shoe and the band then tightened by pulling on the band to slide the band through the apertures of at least some of the clips.

Figure 3:
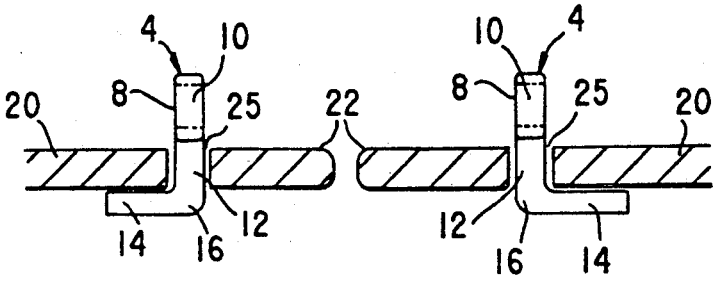
FIG. 3 is a part-sectional view of a part of an upper part of a shoe in which two of the preferred fastening members of FIG. 1 have been releasably engaged.

FIG. 3 shows in part-cross-section two clips 4 which have been engaged in respective openings 25 in the upper part 20 of a shoe. The upper part 20 has two opposed edges 22 to be drawn together by the device for the purpose of securing the shoe onto the foot of a wearer. In use, as the band, which is threaded through the aperture 10 of each clip 4, is tightened, the opposed edges 22 are drawn together and the second leg portions 14 of the clips 4 abut the lower surface of the upper part 20 of the shoe, as shown. This abutment limits rotational motion of the upper portions 8 of each clip 4 towards the edges 22, thereby maintaining the first leg portions 12 of the clips 4 in a substantially vertical condition, as shown. This maintains a maximum distance between the upper portions 8 of clips 4 attached to opposite edges 22, so that a maximum length of band will be visible from above when the shoe is secured on the foot. This also helps to eliminate injury or discomfort to the wearer due to either of portions 14 or 16 of the clips 4 protruding into the foot space within the shoe. The size of the rotational moment produced in each clip 4 by tension in the band may be reduced by reducing the height of the upper, apertured portion 8 of the clip, so that the clips are "low profiled" when engaged with the shoe.

Two alternative forms of fastening member in accordance with the second form of fastening member mentioned above are shown in FIGS. 4 and 5.

Figure 4:
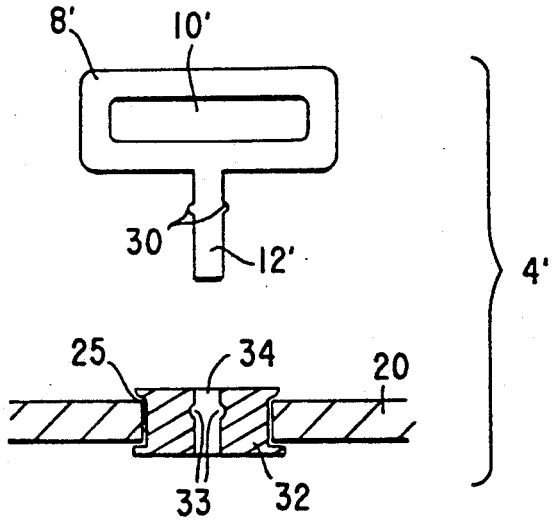
FIG. 4 shows an alternative form of fastening member for use in the device of the invention.

In FIG. 4 an alternative fastening member 4' comprises a male member 8' and a female member 32. The male member 8' has an aperture 10' through which the band (not shown) passes and is slidable relative thereto. The male member 8' includes a pin 12' having one or more protrusions 30 formed thereon. The female member 32 is in the form of a grommet which is attached to the opening 25 in the upper part of the shoe 20. The female member 32 may be permanently or releasably secured in the opening 25, as was mentioned earlier. As seen in the Figure, the flanged portions of the female member 32 prevent the member from being unintentionally dislodged from the opening during normal use. The size of the flanges relative to the size of the opening may be selected to give the required degree of security. When the female member 32 is designed to be releasable, the elasticity of the material of the upper part 20 of the shoe may be exploited to allow the female member 32 to be simply "popped" into or out of place in the opening 25. Through the center of the female member 32 is a hole 34, which is of similar cross-sectional shape to the pin 12' of the male wall of the hole 34 are one or more corresponding recesses 33, for engagement with the respective protrusion[s] 30 on the pin 12' of the male member 8'. Thus, the male 8' and female 32 members are releasably interengagable by means of the snap-fitting connection thus formed. Of course, it is possible for the same snap-fitting connection to be formed by providing the recesses 33 on the pin 12' of the male member 8' and the protrusions 30 on the inner wall of the hole 34 of the female member 32.

Figure 5:
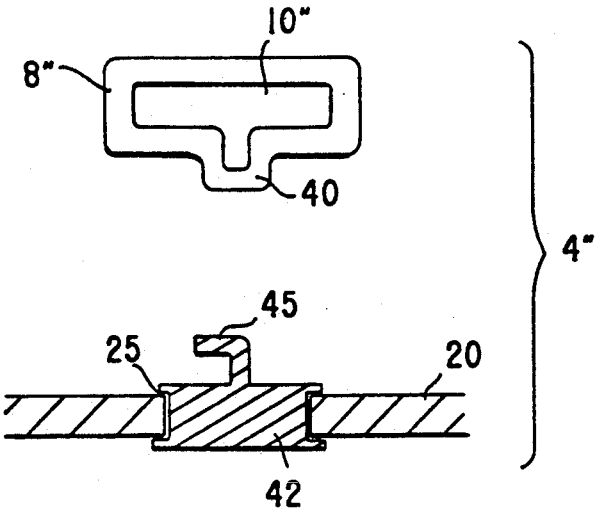
FIG. 5 shows a further alternative form of fastening member for use in the device of the invention.

In FIG. 5 another alternative fastening member 4' comprises a hook member 42 and an eye member 8". The eye member 8" has an aperture 10" formed therein through which the band (not shown) of the device passes and is slidable therewithin. The eye member 8" includes a loop portion 40. The hook member 42 is attached to an opening 25 in the upper part 20 of the shoe in an analogous manner to the female member 32 of FIG. 4 above and the same comments apply here also. The hook member 42 includes a hook portion 45 projecting upwardly from the plane of the upper part of the shoe. The hook portion 45 is preferably angled as shown, or alternatively may be of arcuate cross-section, in order that the eye member 8" may be easily engaged and disengaged therefrom. The hook 42 and eye 8" members are releasably interengagable by engagement of the loop portion 40 of the eye member 8" beneath or around the hook portion 45 of the hook member 42.

Figure 7:
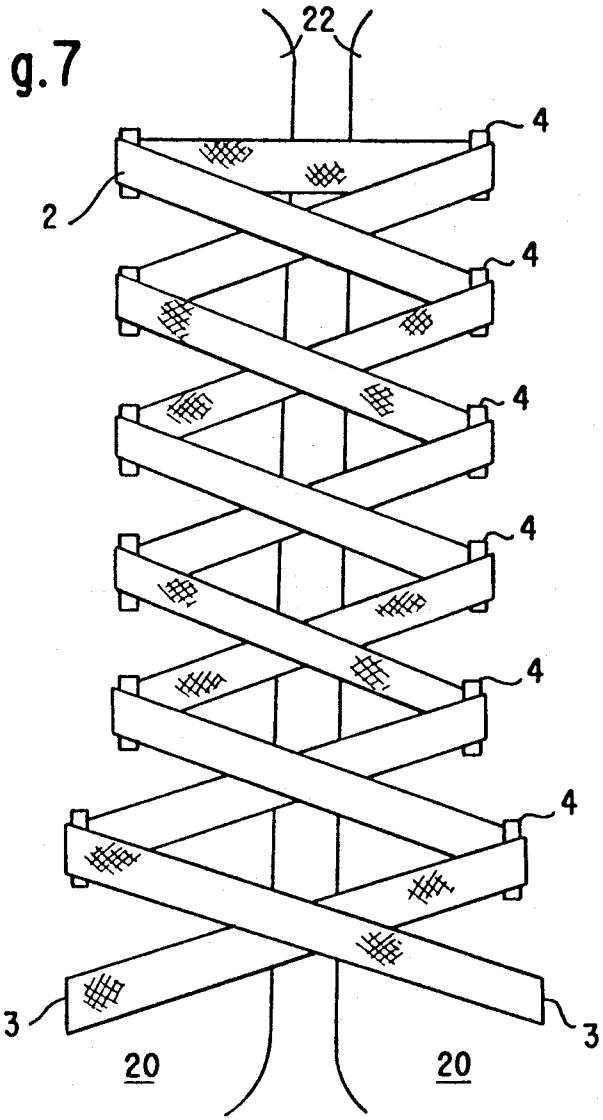
FIG. 7 is a top view of a part of an upper part of a shoe fitted with the device of FIG. 1, illustrating an alternative configuration of the band.
Figure 6:
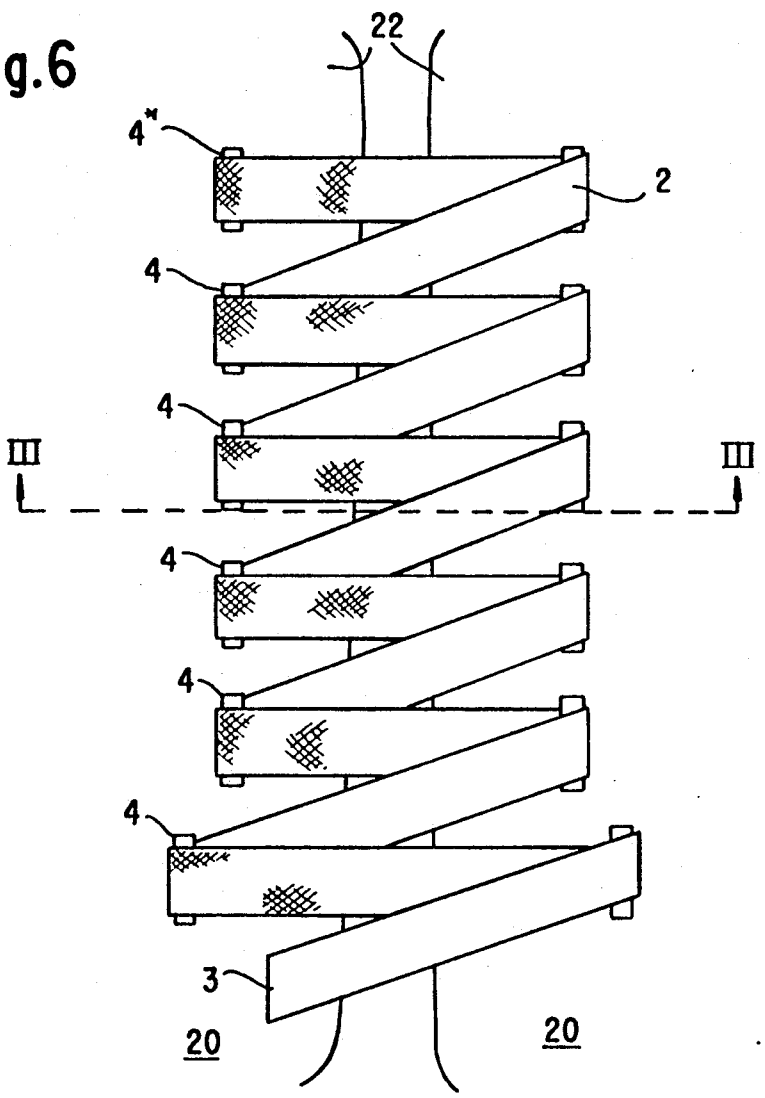
FIG. 6 is a top view of a part of an upper part of a shoe fitted with the device of FIG. 1.

Looking now at FIGS. 6 and 7, these Figures show two alternative ways of attaching the device 1 to the upper part 20 of a shoe. In FIG. 6 one fastening member 4* is a terminal fastening member to which one end of the band 2 is fixedly attached and that terminal fastening member 4* is fixed at that one end of the band 2 and is not slidable along the band 2. This attachment is conveniently provided by a loop formed in an end portion of the band having the terminal fastening member 4* threaded thereon by turning the band end back on itself and securing the end of the band to the main body of the band, thereby trapping the terminal fastening member 4* in the loop of the band thus formed. The band 2 of the device extends across the upper part 20 of the shoe back and forth between the opposed edges 22, each of the fastening members 4 being in releasable engagement with a respective opening in the upper part 20 of the shoe adjacent the edges 22. A cross-sectional view on arrows III—III of FIG. 6 corresponds to FIG. 3, though in the latter the band 2 is omitted for clarity. In order to attach the device 1 to the shoe, once the terminal fastening member 4* has been engaged with its respective opening adjacent one edge 22, the next successive fastening member 4 is slid along the band 2 until it reaches a suitable position to enable it to be engaged with its respective opening adjacent the other one of the two opposed edges 22. Then, the next fastening member 4 is similarly slid along the band 2 until it too is in a suitable position for engagement with its respective opening adjacent the same edge 22 as the terminal fastening member 4*. In a similar manner, the remaining fastening members 4 on the band 2 are positioned and engaged with their respective openings adjacent alternate edges 22. Once the band 2 has been tightened by pulling the band through at least some of the fastening members 4, in order to secure the shoe onto the foot of the wearer, the free end 3 of the band can be secured by any suitable means, as has already been discussed. Velcro (trademark) material or a permanent fixture (e.g. a buckle or cleat) provided on the upper part of the shoe is preferred. FIG. 7 differs from FIG. 6 only in that there is no terminal fastening member 4* fixed at one end of the band 2, but rather the band is attached to the shoe starting with its center and not one of its ends. Thus, both halves of the band are attached to the shoe simultaneously, by first engaging the two central fastening members with their respective openings adjacent opposite edges 22, and then engaging the remaining fastening members located on each half of the band 2 in succession in a similar manner to that described above. Thus, in the method represented in FIG. 7, the band is left with two free ends 3 which may be simply tied together or secured by means of Velcro or a permanent fixture provided on the upper part of the shoe. It will be appreciated that owing to the greater variety of materials and textures available for the band 2 of the device of this invention, it may not be possible to tie together the free ends 3 successfully, in which case one of the other methods of securing the free ends will be necessary.

Figure 8:
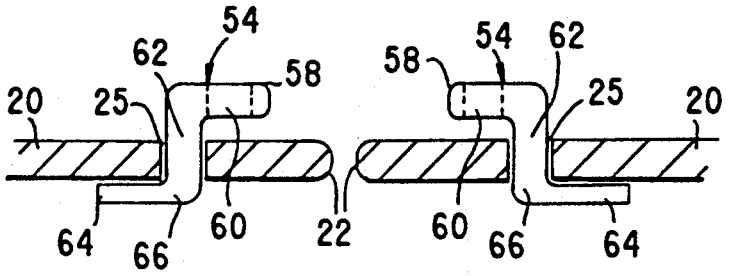
FIG. 8 is a part-sectional view of a part of an upper part of a shoe, fitted with a modified form of the preferred fastening member of FIG. 1.
Figure 10:
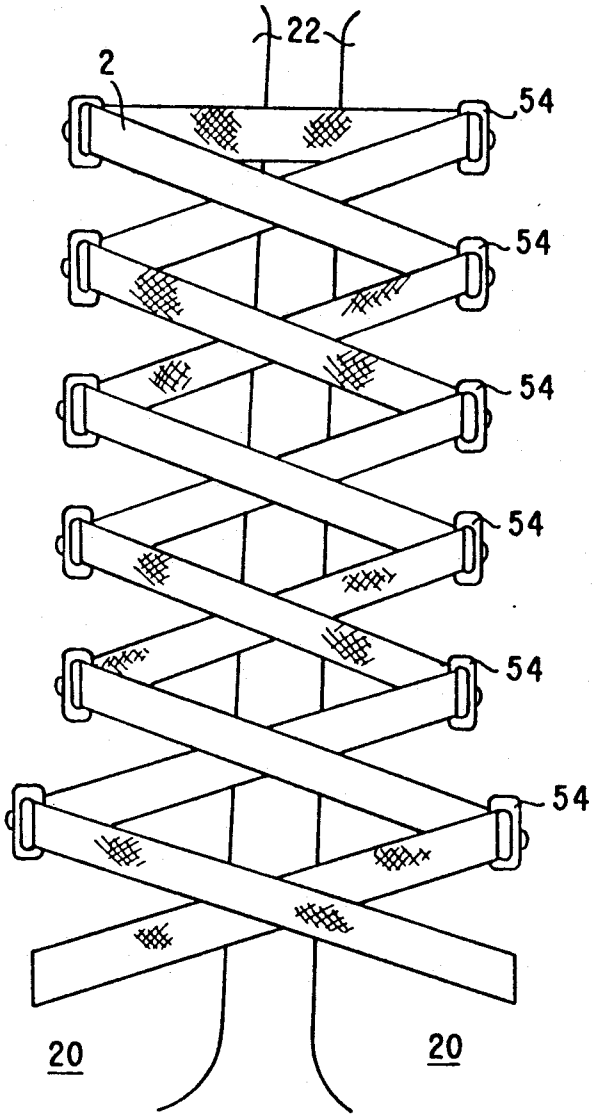
FIG. 10 corresponds to FIG. 7 and shows the upper part of the shoe fitted with a device comprising the modified fastening members shown in FIG. 8, illustrating an alternative configuration of the band.
Figure 9:
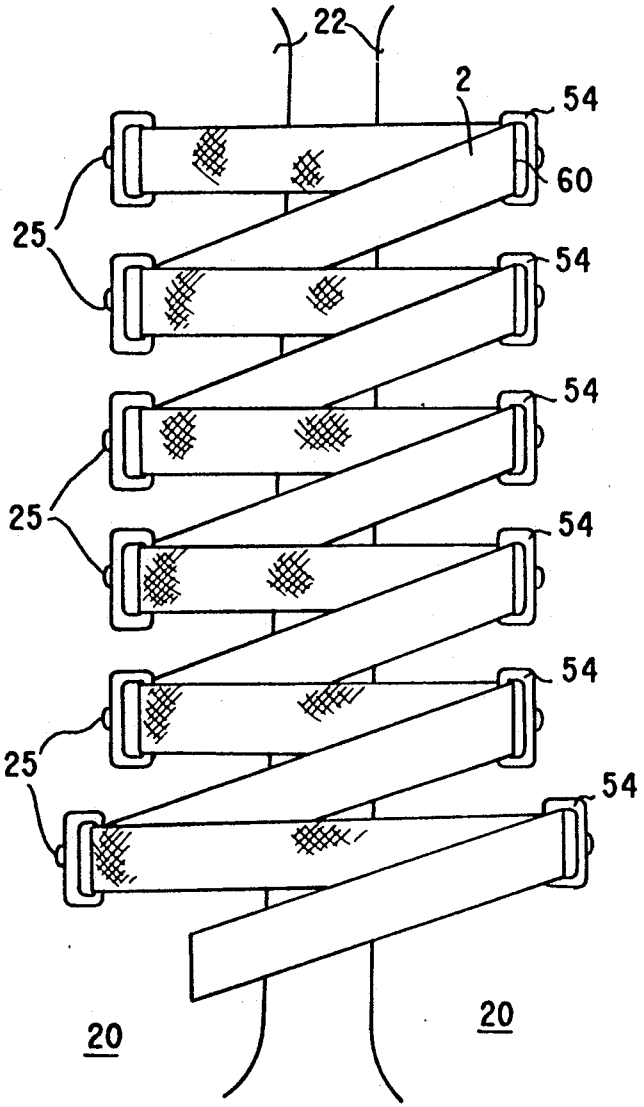
FIG. 9 corresponds to FIG. 6 and shows the upper part of the shoe fitted with a device comprising the modified fastening members shown in FIG. 8.

FIGS. 8, 9 and 10 illustrate the configuration and use of a variant of the form of fastening member shown in FIGS. 1-3. This modified fastening member 54 comprises a first leg portion 62 and a second leg portion 64 joined by an arcuate bridging portion 66, as before. The difference here, however, is that instead of the upper, apertured portion 8 [see FIG. 3] being oriented so as to be in a plane containing the first leg portion 12, the apertured portion 58 [FIG. 8] is oriented so as to be substantially perpendicular to the plane containing the first leg portion 62, i.e. the apertured portion 58 lies in a plane substantially parallel to but spaced from the plane containing the second leg portion 64. In use, the band 2 is threaded through the aperture 60 of each fastening member 54 in the same manner as before. Thus, when the shoe is secured on the foot of the wearer, in the embodiment of FIG. 3 the axis of the aperture 10 is substantially horizontal as shown and is thus substantially parallel to the part of the upper part 20 of the shoe containing the respective opening 25, whereas in the embodiment of FIG. 8 the axis of the aperture 60 is substantially vertical as shown and is thus substantially perpendicular to the part of the upper part 20 of the shoe containing the respective opening 25. Of course, the upper portion 58 of the fastening members 54 of FIG. 8 may be angled with respect to the first leg portion 62 at angles other than 90 degrees, if desired. However, it will be appreciated that in the embodiment of FIG. 8 the distance between upper portions 58 of fastening members 54 attached to openings 25 adjacent opposite edges 22 is somewhat less than the corresponding distance in the embodiment of FIG. 3. This reduces the length of band available for view when the shoe is secured to the foot, thereby reducing the potential visual impact of a decorative band. FIGS. 9 and 10 illustrate the two alternative ways of attaching the band 2 to the upper part of the shoe, corresponding to FIGS. 6 and 7, respectively. Due to the "S" configuration of each modified fastening member 54, in FIGS. 9 and 10 a portion of each of the openings 25 in the upper part 20 of the shoe is visible from above.

It will be appreciated that in FIGS. 6, 7, 9 and 10 the number, spacing and positioning of the openings 25 may vary from shoe to shoe. By way of example only, the last openings to have a fastening member engaged in them are shown in the Figures as being spaced further from their respective edges than the remaining openings. This configuration of openings is commonly found on conventional types of shoe.

It should also be noted that in FIGS. 6, 7, 9 and 10, the angular orientation of some or all of the fastening members 4 [or 54] may vary slightly from that illustrated, because the configuration of each fastening member allows it to orient itself under tension from the band so as to bisect the angle between the incoming and outgoing portions of the band.

In FIG. 11 there is shown another modified form of the fastening member of FIGS. 1-3. As before, each fastening member 74 comprises a vertical, upper portion 78 having an aperture 80 therein, and a first leg portion 82 located in a respective opening 25 and a second leg portion 84 abutting the lower surface of the upper part 20 of the shoe, the first 82 and second 84 leg portions being joined by an arcuate bridging portion 86. In this embodiment, however, the upper portion 78 of the fastening member 74 is spaced from the respective opening 25 in a direction away from the respective edge 22 and is connected to the first leg portion 82 by an intermediate portion 88 which is substantially parallel to the second leg portion 84. As can be seen from FIG. 11, in this embodiment the distance between upper portions 78 of fastening members 74 attached to openings 25 adjacent opposite edges 22 is somewhat greater than the corresponding distance in the embodiment of FIG. 3. This, therefore, increases the length of band available for view when the shoe is secured to the foot, thereby increasing the potential visual impact of a decorative band. The length of the intermediate portion 88 may vary, depending upon the desired distance between upper portions 78 of opposite fastening members 74. Insertion and removal of the fastening members 74 of this embodiment into and out of their respective openings 25 is achieved by manual manipulation, as before, the upper part of the shoe preferably being flexible to assist this manipulation.

Figure 12A:
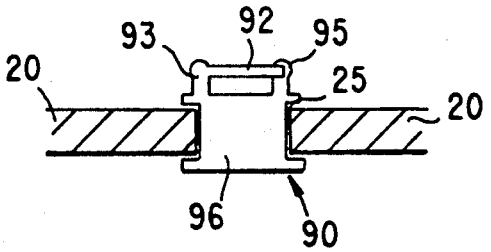
FIG. 12(*a*) and 12(*b*) are, respectively, part-sectional and top views of yet another alternative form of fastening member for use in the device of the invention.
Figure 12B:
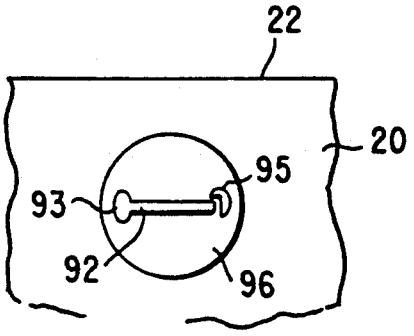

FIG. 12 shows yet another alternative form of fastening member for use in the invention, this one being in accordance with the third form of fastening member mentioned earlier. This fastening member 90 comprises a flanged body portion 96 which is engaged with a respective opening 25 in the upper part 20 of the shoe in an analogous manner to the similarly shaped elements 32 and 42 of the embodiments shown in FIGS. 4 and 5. Similar comments apply to this body portion 96 as were made earlier in respect of those elements 32 and 42 of FIGS. 4 and 5. Extending upwardly from the body portion 96 are posts 93 and 95 and hingedly attached to post 93 is one end of a gate portion 92. The other end of the gate portion 92 abuts post 95, more particularly a cut away portion thereof, as seen in FIG. 12 (*b*). Thus, post 93, gate portion 92 and post 95 form a loop which may be opened or closed, depending upon whether the gate portion 92 is hinged away from or towards the cut away post 95. The shape and size of the loop may vary in a similar manner to the aperture of fastening members of other embodiments, e.g. depending upon the characteristics of the band to be used in the device. Preferably the gate portion 92 is biassed towards its closed position by making the gate portion 92 integral with the post 93 and relying on the resilience of the connection therebetween and/or of the gate portion 92 itself to urge the free end of the gate portion 92 into its normal, closed position in abutment with the cut away post 95. The cut away feature of the post 95 is optional, but helps to prevent the band of the device slipping past the free end of the gate portion 92 unintentionally. The posts 93 and 95 may be integral with the body portion 95 or formed separately and attached thereto by any suitable means, as desired. As discussed earlier, the one-way operation of this fastening member enables a respective portion of the band of the invention to be removably attached to it in a quick and simple manner, by simply pushing the gate portion 92 open and sliding the portion of the band past the free end thereof so as to be contained within the loop.

An alternative embodiment of this third form of fastening member, as has already been mentioned, comprises a hook portion for simply retaining a respective portion of the band therebehind or thereunder. An example of such a fastening member is as shown in the lower half of FIG. 5, i.e. flanged hook member 42 comprising the hook portion 45. Similar comments apply here as were made earlier in respect of that element 42 of FIG. 5, except that in this embodiment the band of the device is removably attached directly to the hook member 42 and not via an eye member 8''. The size, shape and width of the hook portion 45 of this embodiment may vary, depending upon the characteristics of the band to be retained thereby.

Referring now to FIG. 13, which shows one embodiment of a cover for an upper part of a shoe in accordance with the third aspect of the invention, the cover 100 comprises a sheet member 102 and a plurality of fastening members 104 The sheet member 102 may be generally rectangular as shown, or may be of any other desired shape which has dimensions sufficient to overlie and cover at least that portion of the upper part of the shoe containing the openings adjacent the opposed edges. The preferred material for the sheet member 102 is Spandex (trademark). In this embodiment each of the fastening members 104 is a clip having an upper portion which is attached to the sheet member 102 either permanently or temporarily. Conveniently, the upper portion of each clip 104 is in the form of a grommet which is engaged in a respective hole formed in the sheet member 102, although any other suitable form of attachment may be used, as will be appreciated by persons skilled in the art. Each of the clips 104 further comprises a leg which can be inserted into a respective opening in the upper part of the shoe, in the same manner as the leg portions of the clips 4, 54 and 74 described above in respect of other aspects of the invention. The fact that the openings may already accommodate normal shoe laces of a conventionally tied shoe will not usually affect the use of this form of engagement means, since only rarely will the holes be substantially occupied by the laces so as to leave no room for insertion of the leg portions of the clips. Similar modifications to the form and configuration of the clips 104 may be made as have already been described above in respect of clips 4, 54 and 74 of other aspects of the invention.

In use, the cover 100 is attached to the upper part of the shoe once the shoe has been secured onto the foot of the wearer by the laces or other securing device. The elasticity of the sheet member 102 enables it to be stretched to a desired degree so as to bring the fastening clips 104 into register with their respective openings in the shoe and with which they are then engaged as described above to attach the cover to the upper part of the shoe. The required degree of stretching of the sheet member 102 will usually depend upon the size of the shoe and the spacing of the anchor points of the clips on the sheet member.

FIG. 14 shows an alternative form of cover 100, in which the fastening members 104 are arranged in pairs and each has a portion forming a hook which is able to be either clipped over a section of the lace or band used to secure the shoe on the foot or simply clipped over the rim of a respective opening in the upper part of the shoe. The clips of each pair are attached by conventional means to opposite ends of a respective resilient element 110, which is for example a length of elastomeric material or a spring, e.g. a metal coil spring. As shown in the Figure, the resilient element(s) 110 may conveniently be secured to the sheet member 102 by virtue of channels 112 provided in or on one surface of the sheet member 102. In this embodiment, as the hooked clips may be anchored to different parts of the secured shoe, in order to facilitate engagement to either the lace or the openings, as the case may be, it may be desirable for the channels 112 which accommodate the resilient elements 110 to be oriented appropriately, i.e. either substantially parallel to or transverse to the direction of the opposed edges of the upper part of the shoe. It will be appreciated that in this embodiment the adjustability of the cover so as to fit a desired size of shoe is provided by the resilient elements, rather than the elastic sheet member 102 itself of the embodiment of FIG. 13 Thus, in the cover shown in FIG. 14, the sheet member may simply be of a flexible material, e.g. a flexible plastic, and may be of any desired shape, an example of which is illustrated.

In the covers of both FIGS. 13 and 14, the upper surfaces of the sheet members (the front surface of the sheet member shown in FIG. 13 and the rear surface of that shown in FIG. 14) can be decorated in any desired manner, e.g. according to the demands of fashion or personal taste.

What is claimed is:

1. A device of securing a shoe onto a foot of a wearer, the shoe comprising an upper part having a pair of opposed edges to be drawn together by said device, said upper part having a plurality of openings therein adjacent each of said edges, said device comprising:

a longitudinally extending band having an elongate cross sectional shape wherein the width dimension of the band significantly exceeds the height dimension of the band;

a plurality of fastening members each for attachment to said band and each for engagement with a respective opening in said upper part of said shoe, so that said band extends across said upper part back and forth between said edges, to removably attach said band to said upper part at each of said openings without being threaded through said openings; wherein, each of said fastening members includes a passageway for accommodating and sliding along the length of said band along an axis of said passageway, said passageway shape corresponding to the elongate cross sectional shape of said band along a section of said passageway transverse to said axis.

2. A device as in claim 1, wherein said band has at least one decorative surface, at least part of which is visible when said shoe is secured to said foot.

3. A device as in claim 1, wherein said band is stretchable in the longitudinal direction.

4. A device as in claim 1, wherein said band is made of cloth.

5. A device as in claim 1, wherein said band is made of plastic.

6. A device as in claim 1, wherein each of said fastening members is attached to said band and is adapted for releasable engagement with said respective opening in said upper part of said shoe.

7. A device as in claim 6, wherein each of said fastening members is a clip comprising an upper portion including said passageway which is attached to said band and a leg adapted for insertion through a respective opening from above for releasable engagement of said clip with said respective opening.

8. A device as in claim 7, wherein said leg includes a first leg portion for location in said respective opening and a second leg portion angled with respect to said first leg portion for preventing disengagement of said clip from said respective opening when said shoe is secured on said foot.

9. A device as in claim 8, wherein second leg portions of successive clips along said band point in the same longitudinal direction along said band but are located on opposite sides thereof, so that when said shoe is secured on said foot, said second leg portion of each clip points in a direction away from said opposed edges.

10. A device as in claim 8, wherein said first and second leg portions are connected by an arcuate bridging portion.

11. A device as in claim 7, wherein said clip further comprises an intermediate portion between said upper portion and said leg for spacing said upper portion from said respective opening in a direction away from said opposed edges when said shoe is secured on said foot.

12. A device as in claim 7, wherein said clips are of metal.

13. A device as in claim 7, wherein said clips are of plastic.

14. A device as in claim 13, wherein said clips are of nylon.

15. A device as in claim 1, wherein each of said fastening member comprises a first fastening element attached to said band and a second fastening element engaged with said respective opening, said first and second fastening elements being releasably interengagable and defining said passageway for removably attaching said band to said upper part of said shoe at said openings.

16. A device as in claim 15, wherein said first fastening element is one of a hook member and an eye member and said second fastening element is the other of said hook member and said eye member.

17. A device as in claim 15, wherein said first fastening element is one of a female member and a male member and second fastening element is the other of said female member and said male member.

18. A device as in claim 17, wherein said female and male members are releasably interengagable by means of at least one protrusion on one of said members and at least one corresponding recess in the other of said members, said protrusion(s) and recess(es) forming a snap-fitting connection between said female and male members.

19. A device as in claim 1, wherein each of said fastening members is engaged with said respective opening and is adapted for releasable attachment to said band.

20. A device as in claim 19, wherein each of said fastening members comprises a hook defining said passageway for releasably retaining a respective portion of said band.

* * * * *